US010704813B2

(12) United States Patent
Lozyniak et al.

(10) Patent No.: US 10,704,813 B2
(45) Date of Patent: Jul. 7, 2020

(54) EJECTORS AND METHODS OF MANUFACTURE

(71) Applicant: Carrier Corporation, Palm Beach Gardens, FL (US)

(72) Inventors: Steven A. Lozyniak, South Windsor, CT (US); Alexander Lifson, Manlius, NY (US); Zuojun Shi, Marcellus, NY (US); Parmesh Verma, South Windsor, CT (US); Kenneth E. Cresswell, Cazenovia, NY (US); J. Michael Griffin, Allentown, PA (US); Thomas D. Radcliff, Vernon, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 16/448,577

(22) Filed: Jun. 21, 2019

(65) Prior Publication Data

US 2019/0331373 A1 Oct. 31, 2019

Related U.S. Application Data

(63) Continuation of application No. 15/109,655, filed as application No. PCT/US2015/011941 on Jan. 20, 2015, now abandoned.

(Continued)

(51) Int. Cl.

| | |
|---|---|
| ***F25B 41/00*** | (2006.01) |
| ***F25B 9/08*** | (2006.01) |
| ***F04F 5/46*** | (2006.01) |

(52) U.S. Cl.

CPC ..... *F25B 41/00* (2013.01); *F04F 5/46* (2013.01); *F25B 9/08* (2013.01); *F05D 2260/601* (2013.01); *F25B 2341/001* (2013.01)

(58) Field of Classification Search

CPC ..... F25B 41/00; F25B 2341/00; F25B 2341/001; F25B 2341/0011;

(Continued)

(56) References Cited

U.S. PATENT DOCUMENTS

| | | | |
|---|---|---|---|
| 1,836,318 | A | 12/1931 | Gay |
| 3,277,660 | A | 10/1966 | Kemper et al. |

(Continued)

FOREIGN PATENT DOCUMENTS

| | | | |
|---|---|---|---|
| CN | 202521934 | U | 11/2012 |
| EP | 0889244 | A2 | 1/1999 |

(Continued)

OTHER PUBLICATIONS

International Search Report and Written Opinion for PCT/US2015/011941 dated Jul. 7, 2015.

(Continued)

*Primary Examiner* — Jianying C Atkisson
*Assistant Examiner* — Miguel A Diaz
(74) *Attorney, Agent, or Firm* — Bachman & LaPointe, P.C.

(57) ABSTRACT

An ejector has: a motive flow inlet; a secondary flow inlet; an outlet; a motive nozzle; a diffuser; and a control needle shiftable between a first position and a second position. The ejector comprises: an inlet body bearing the motive flow inlet and the secondary flow inlet; a diffuser body forming the diffuser and bearing the outlet; a motive nozzle insert forming the motive nozzle in a compartment in the inlet body; and a needle guide insert in the motive nozzle insert.

20 Claims, 3 Drawing Sheets

Related U.S. Application Data

(60) Provisional application No. 61/933,766, filed on Jan. 30, 2014.

(58) Field of Classification Search
CPC .... F25B 2341/0012; F25B 9/08; F04B 23/04; F04F 5/00; F04F 5/46; F04F 5/461; F04F 5/54; F05D 2260/601
See application file for complete search history.

(56) References Cited

U.S. PATENT DOCUMENTS

| | | | | |
|---|---|---|---|---|
| 4,041,981 | A | 8/1977 | Davis et al. | |
| 6,017,195 | A | 1/2000 | Skaggs | |
| 6,138,456 | A | 10/2000 | Garris | |
| 6,601,832 | B1 | 8/2003 | Palmu | |
| 6,858,340 | B2 | 2/2005 | Sugawara et al. | |
| 7,334,427 | B2 | 2/2008 | Ozaki et al. | |
| 7,354,029 | B1 | 4/2008 | Rutstein | |
| 7,779,647 | B2 | 8/2010 | Takeuchi et al. | |
| 7,823,400 | B2 | 11/2010 | Oshitani et al. | |
| 8,017,275 | B2 * | 9/2011 | Fukuma | F04F 5/461 417/178 |
| 8,105,050 | B2 | 1/2012 | Yamada et al. | |
| 8,523,091 | B2 | 9/2013 | Ogata et al. | |
| 8,999,593 | B2 | 4/2015 | Kato et al. | |
| 10,202,984 | B2 * | 2/2019 | Tell | F04F 5/22 |
| 2004/0172966 | A1 | 9/2004 | Ozaki et al. | |
| 2004/0255611 | A1 | 12/2004 | Nishijima et al. | |
| 2005/0155374 | A1 * | 7/2005 | Oshitani | F25B 41/00 62/500 |
| 2005/0188719 | A1 | 9/2005 | Sugiura et al. | |
| 2007/0039350 | A1 | 2/2007 | Takeuchi et al. | |
| 2007/0186572 | A1 * | 8/2007 | Nishida | F25B 41/00 62/170 |
| 2008/0060378 | A1 | 3/2008 | Gocho et al. | |
| 2009/0155092 | A1 | 6/2009 | Fukuma | |
| 2009/0297367 | A1 | 12/2009 | Yamada et al. | |
| 2009/0311111 | A1 | 12/2009 | Yoshii | |
| 2009/0317691 | A1 | 12/2009 | Yamada et al. | |
| 2010/0209819 | A1 | 8/2010 | Fukuma et al. | |
| 2013/0167566 | A1 | 7/2013 | Alahyari | |
| 2013/0239600 | A1 | 9/2013 | Verma et al. | |
| 2013/0277448 | A1 * | 10/2013 | Liu | F25B 49/02 239/11 |
| 2014/0083121 | A1 | 3/2014 | Chiappetta, Jr. et al. | |
| 2014/0157807 | A1 | 6/2014 | Cogswell et al. | |
| 2016/0327319 | A1 * | 11/2016 | Lozyniak | F25B 41/00 |
| 2017/0108256 | A1 | 4/2017 | Verma et al. | |
| 2017/0356683 | A1 | 12/2017 | Park et al. | |
| 2019/0091704 | A1 * | 3/2019 | McEwen | F04F 5/20 |
| 2019/0331139 | A1 * | 10/2019 | Short | F04F 5/463 |
| 2019/0331373 | A1 * | 10/2019 | Lozyniak | F25B 41/00 |

FOREIGN PATENT DOCUMENTS

| | | | |
|---|---|---|---|
| EP | 1998053 | A2 | 12/2008 |
| GB | 2207952 | A | 2/1989 |
| JP | 2005233121 | A | 9/2005 |
| WO | 2012/074650 | A1 | 6/2012 |
| WO | 2012/115698 | A1 | 8/2012 |

OTHER PUBLICATIONS

U.S. Office Action for U.S. Appl. No. 15/109,655, dated Apr. 25, 2018.
U.S. Office Action for U.S. Appl. No. 15/109,655, dated Nov. 26, 2018.

* cited by examiner

EJECTORS AND METHODS OF MANUFACTURE

CROSS-REFERENCE TO RELATED APPLICATIONS

This is a continuation of Ser. No. 15/109,655, filed Jul. 4, 2016, entitled "Ejectors and Methods of Manufacture" which is a 371 U.S. national stage application of PCT/US2015/011941, filed Jan. 20, 2015, which claims benefit of U.S. Patent Application No. 61/933,766, filed Jan. 30, 2014, the disclosures of which are incorporated by reference herein in their entireties as if set forth at length.

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62. An expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet (exit) 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary inlet and secondary inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

SUMMARY

One aspect of the disclosure involves an ejector having: a motive flow inlet; a secondary flow inlet; an outlet; a motive nozzle; a diffuser; and a control needle shiftable between a first position and a second position. The ejector comprises: an inlet body bearing the motive flow inlet and the secondary flow inlet; a diffuser body forming the diffuser and bearing the outlet; a motive nozzle insert forming the motive nozzle in a compartment in the inlet body; and a needle guide insert in the motive nozzle insert.

In one or more embodiments of any of the foregoing embodiments, the needle guide insert is brazed to the motive nozzle insert.

In one or more embodiments of any of the foregoing embodiments, the motive nozzle insert is brazed to the compartment.

In one or more embodiments of any of the foregoing embodiments, the inlet body is a first piece and the diffuser body is a second piece.

In one or more embodiments of any of the foregoing embodiments, the inlet body is metallic and the diffuser body is metallic.

In one or more embodiments of any of the foregoing embodiments, the inlet body is threaded to the diffuser body.

Another aspect of the disclosure involves an ejector having: a motive flow inlet; a secondary flow inlet; an outlet; a motive nozzle; and a diffuser. The ejector comprises: an inlet body bearing the motive flow inlet and the secondary flow inlet; a diffuser body forming the diffuser and bearing the outlet; and a motive nozzle insert forming the motive nozzle in a compartment in the inlet body, said compartment having a downstream-facing surface abutting an upstream facing surface of the motive nozzle insert.

In one or more embodiments of any of the foregoing embodiments, the ejector further comprises: a control needle shiftable between a first position and a second position; and a needle guide insert in the motive nozzle insert.

In one or more embodiments of any of the foregoing embodiments, the needle guide insert is brazed to the motive nozzle insert.

In one or more embodiments of any of the foregoing embodiments, the motive nozzle insert is brazed to the compartment.

In one or more embodiments of any of the foregoing embodiments, the inlet body is a first piece and the diffuser body is a second piece.

In one or more embodiments of any of the foregoing embodiments, the inlet body is metallic and the diffuser body is metallic.

In one or more embodiments of any of the foregoing embodiments, the inlet body is threaded to the diffuser body.

Another aspect of the disclosure involves a method for manufacturing an ejector, the ejector having: a motive flow inlet; a secondary flow inlet; an outlet; a motive nozzle; a diffuser; an inlet body bearing the motive flow inlet and the secondary flow inlet; a diffuser body forming the diffuser and bearing the outlet; and a motive nozzle insert forming the motive nozzle in a compartment in the inlet body. The method comprises inserting the motive nozzle insert into the compartment from an opening in a downstream end of the inlet body and mating the diffuser body to the downstream end of the inlet body.

In one or more embodiments of any of the foregoing embodiments, the ejector further comprises: a control needle shiftable between a first position and a second position; and a needle guide insert in the motive nozzle insert; and the method further comprises inserting the needle guide insert into the motive nozzle insert In one or more embodiments of any of the foregoing embodiments, the method further comprises brazing the needle guide insert to the motive nozzle insert.

In one or more embodiments of any of the foregoing embodiments, the mating the diffuser body to the downstream end of the inlet body comprises threading.

In one or more embodiments of any of the foregoing embodiments, the method further comprises: brazing the motive nozzle insert to the inlet body.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
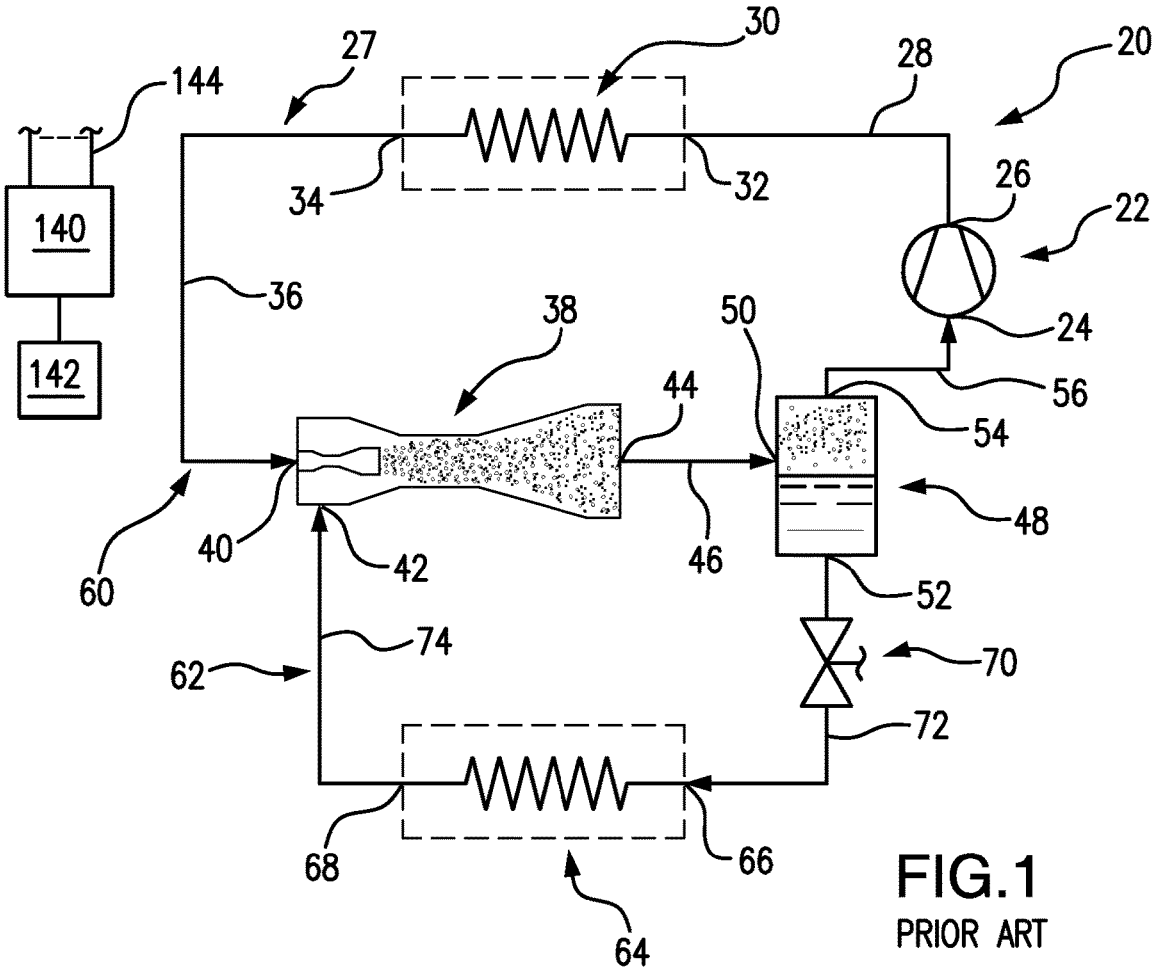
FIG.1 PRIOR ART
FIG. 1 is a schematic view of a prior art ejector refrigeration system.
Figure 2:
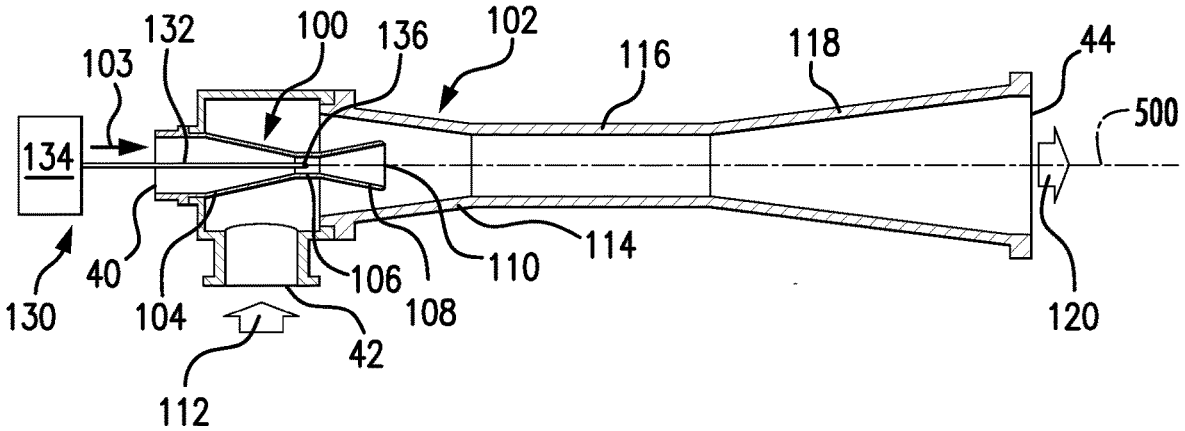
FIG. 2 PRIOR ART
FIG. 2 is an axial sectional view of a prior art ejector.
Figure 3:
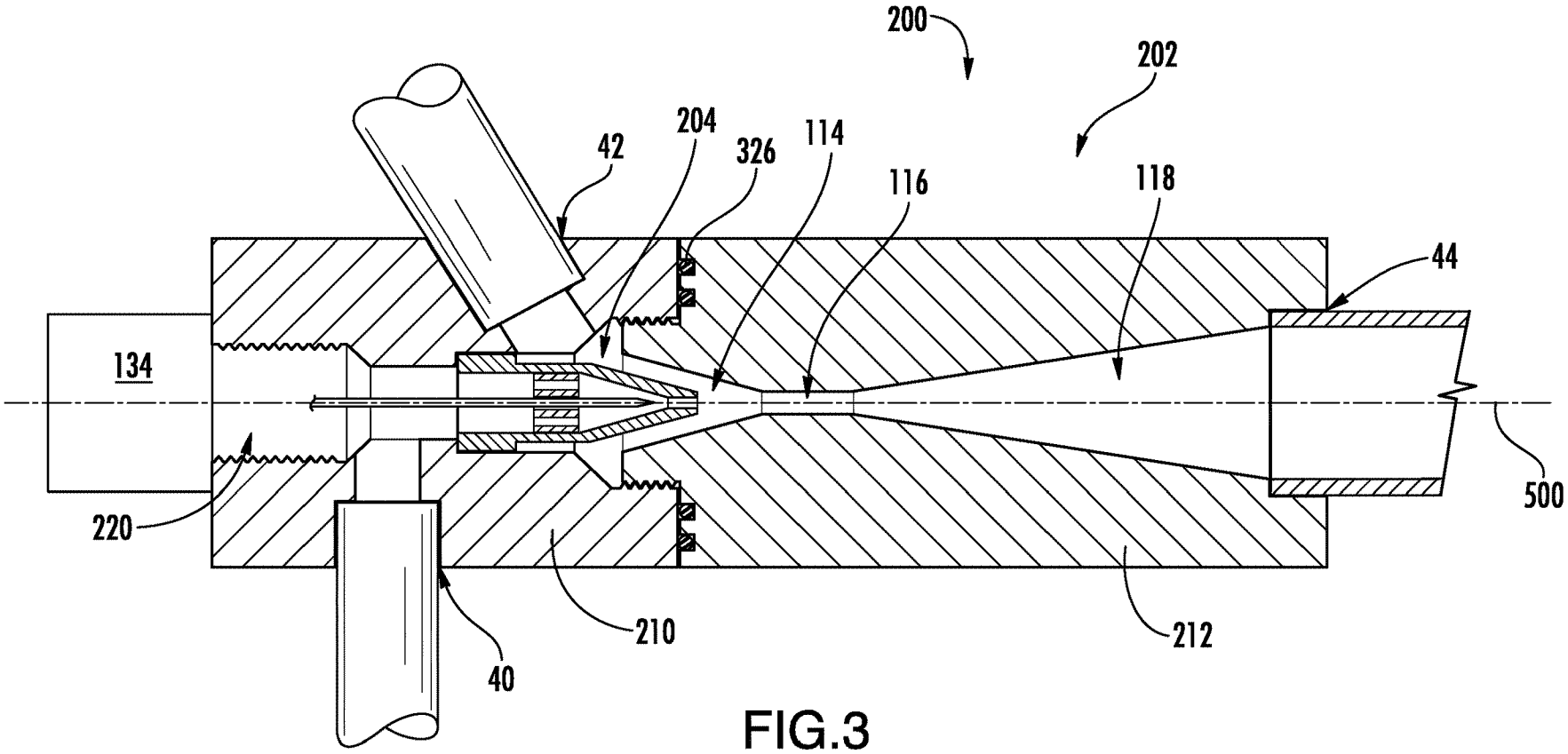
FIG. 3 is an axial sectional view of an ejector.

FIG. 3 shows an ejector 200 comprising a body assembly, 202, including a motive nozzle insert 204 within main portions of the body. General features of an ejector shared with the ejector 38 above are referenced with the same reference numerals.

The exemplary body assembly 202 includes a proximal or upstream portion 210 and a distal or downstream portion 212. As is discussed further below, the exemplary portion 210 defines an inlet body bearing the motive flow inlet 40 and the secondary flow inlet 42. The exemplary portion 202 forms a diffuser body forming the diffuser and the outlet 44. As is discussed further below, the exemplary diffuser body 212 also forms at least a portion of the mixer convergent section 114 and the mixing section 116.

The exemplary inlet body 210 also includes a mounting feature 220 for mounting the needle actuator 134. The exemplary mounting feature 220 is an internally threaded bore.

Figure 4:
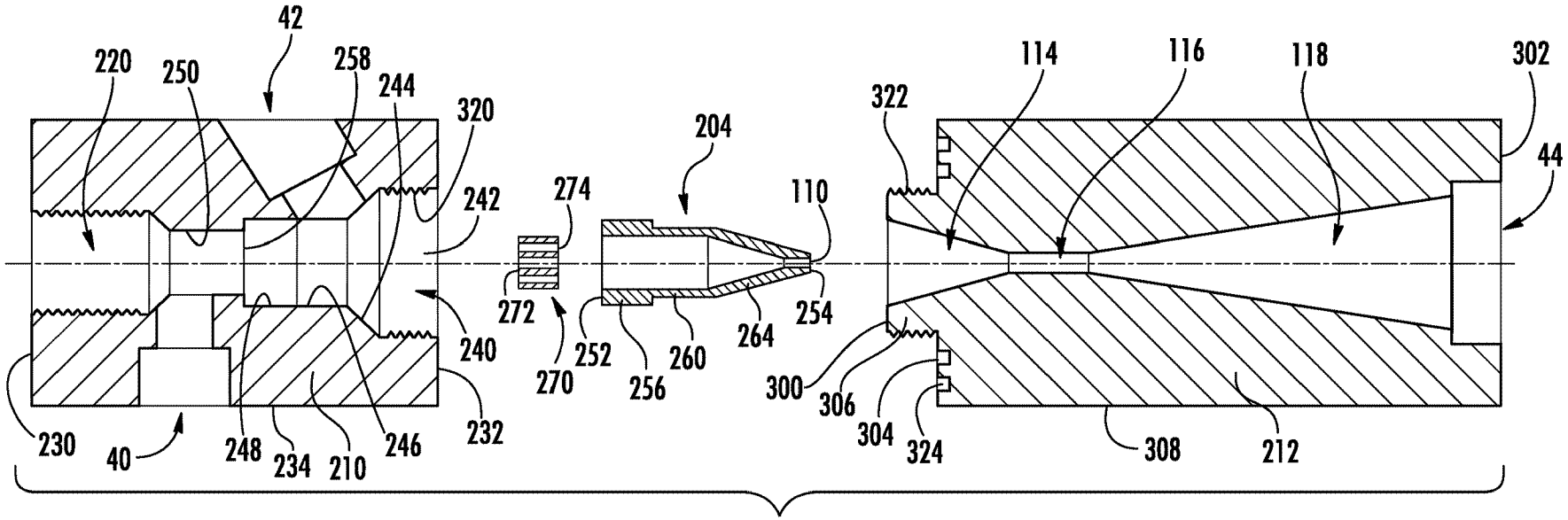
FIG. 4 is a partial exploded axial sectional view of the ejector of FIG. 3.

FIG. 4 shows the inlet body 210 as having a first end 230, a second end 232, and a lateral perimeter 234 between the ends. In the exemplary implementation, the ports 40 and 42 are in the lateral perimeter 234. A compartment 240 extends inward from the second end 232 and is in communication with the ports 40 and 42. The exemplary compartment is stepped, having a relatively wide or broad downstream portion 242 at the end 232 tapering/narrowing inward/upstream with an angled shoulder 244 leading to narrow portion having sequential sections 246, 248, and 250 leading to the bore 220.

As is discussed further below, the motive nozzle insert 204 is at least partially accommodated in and mounted to the compartment 240. The motive nozzle insert 204 extends from a first or upstream end 252 to a downstream end 254 providing the outlet 110. A cylindrical base or mounting portion 256 extends downstream from the end 252 and is dimensioned to be received in the compartment section 246. In the exemplary implementation, the end 252 may abut a shoulder 258 separating the compartment sections 248 and 250. The insert 204 may be secured (e.g., press-fit or brazed in place. Downstream of the mounting portion 256, the exemplary nozzle has a short straight portion 260 extending to a tapering portion 264 externally tapering to the downstream end 254 and forming the convergent and divergent portions of the motive nozzle.

Figure 5:
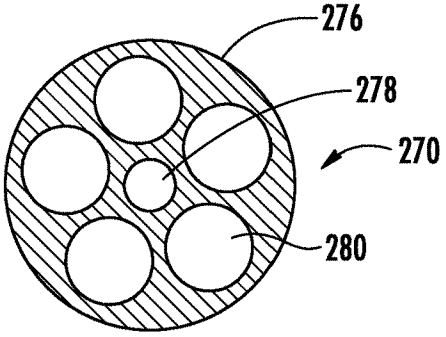
FIG. 5 is an end view of a needle guide of the ejector of FIG. 3.

An interior surface of the nozzle insert 204 within the portions 256 and 260 is essentially cylindrical and accommodates a needle guide 270. The exemplary needle guide 270 (FIG. 5) is formed as an apertured disk extending between first and second ends/faces 272 and 274 (FIG. 4) and having a cylindrical perimeter 276. For passing and guiding the needle, the exemplary guide 270 has a central bore 278. For passing motive flow, the exemplary guide has a plurality of off-center bores 280. The guide 270 may be secured (e.g., press-fit or brazed) into the motive nozzle. Such press-fitting or brazing may be performed prior to installation of the motive nozzle into the inlet body. The exemplary diffuser body 212 extends from an upstream end 300 to a downstream end 302. At the upstream end, a shoulder 304 separates a boss 306 from a main lateral surface 308. The exemplary boss 306 is dimensioned to be received in the portion 242 of the compartment 240 and secured thereto. Exemplary securing is via threaded interaction of an internal thread 320 along the compartment portion 242 and an external thread 322 along the boss. To seal this threaded engagement, one or both of the shoulder 304 and downstream end 232 may bear grooves 324 for retaining O-ring seals 326 (FIG. 3). Alternative implementations involve welded, brazed, or press-fit interactions of the inlet body 210 and the diffuser body 212.

Figure 6:
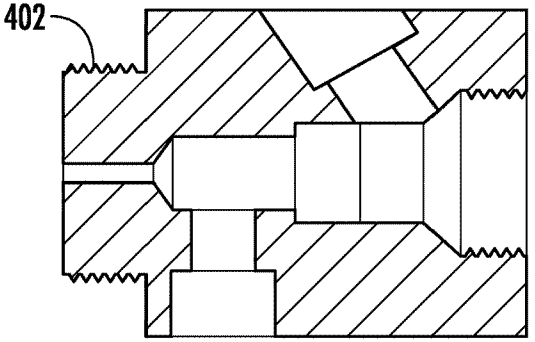
FIG. 6 is an axial sectional view of an alternate inlet body for the ejector of FIG. 3.

FIG. 6 shows an alternate inlet body 400 wherein the actuator mounting feature 402 is an externally threaded boss contrasted with the internally threaded feature 220 of FIG. 4.

In the exemplary mechanical assembly of the actuator body, the needle and actuator may be installed as a unit. Such installation may occur after mechanical assembly of the ejector to associated conduits of the vapor compression system.

Exemplary materials for the inlet body 210 and outlet body 212, insert 204, and guide 270, are metals or alloys (e.g., stainless steels, brass, aluminum and its alloys, and/or titanium and its alloys).

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. An ejector comprising:
a motive flow inlet;
a secondary flow inlet;
an outlet;
a motive nozzle;
a diffuser; and
a control needle shiftable between a first position and a second position,
wherein the ejector comprises:
an inlet body bearing the motive flow inlet and the secondary flow inlet;
a diffuser body separately formed from the inlet body and forming the diffuser and bearing the outlet;
a motive nozzle insert separately formed from the inlet body and diffuser body and forming the motive nozzle in a compartment in the inlet body; and
a needle guide insert in the motive nozzle insert, the needle guide insert having a central bore for passing and guiding the needle and a plurality of off center bores for passing motive flow with a motive flow path sequentially defined:
through the motive flow inlet;
through the motive nozzle insert including through the off-center bores; and
merging with a secondary flow flowpath.

2. The ejector of claim 1 wherein:
the inlet body is a first piece; and
the diffuser body is a second piece.

3. The ejector of claim 1 wherein:
the inlet body is metallic; and
the diffuser body is metallic.

4. The ejector of claim 1 wherein:
the inlet body is threaded to the diffuser body.

5. The ejector of claim 1 wherein:
the inlet body has:
a first end mounting a needle actuator; and
a second end mounted to the diffuser body; and
the motive flow inlet is between the first end and the compartment.

6. The ejector of claim 1 wherein:
the needle guide insert is brazed to the motive nozzle insert.

7. The ejector of claim 6 wherein:
the motive nozzle insert is brazed to the compartment.

8. An ejector comprising:
a motive flow inlet;
a secondary flow inlet;
an outlet;
a motive nozzle; and
a diffuser,
wherein the ejector comprises:
an inlet body bearing the motive flow inlet and the secondary flow inlet;
a diffuser body forming the diffuser and bearing the outlet;
a metallic motive nozzle insert being a separate piece from the inlet body and forming the motive nozzle in a compartment in the inlet body, said compartment having a downstream-facing surface abutting an upstream facing surface of the motive nozzle insert, an upstream end of the motive nozzle insert being within the compartment;

a control needle shiftable between a first position and a second position; and a needle guide insert in the motive nozzle insert, the needle guide insert having a central bore for passing and guiding the needle and a plurality of off-center bores for passing motive flow with a motive flow path sequentially defined:

through the motive flow inlet;

through the motive nozzle insert including through the off-center bores; and merging with a secondary flow flowpath.

9. The ejector of claim 8 wherein:

the needle guide insert is brazed to the motive nozzle insert.

10. The ejector of claim 8 wherein:

the motive nozzle insert is brazed to the compartment.

11. The ejector of claim 8 wherein:

the inlet body is a first piece; and the diffuser body is a second piece.

12. The ejector of claim 8 wherein:

the inlet body is metallic; and the diffuser body is metallic.

13. The ejector of claim 8 wherein:

the inlet body is threaded to the diffuser body.

14. The ejector of claim 8 wherein:

the motive nozzle insert is press-fit into the compartment.

15. The ejector of claim 8 wherein:

the inlet body has:

a first end mounting a needle actuator; and a second end mounted to the diffuser body; and the motive flow inlet is between the first end and the compartment.

16. A method for manufacturing an ejector, the ejector comprising:

a motive flow inlet;

a secondary flow inlet;

an outlet;

a motive nozzle;

a diffuser;

an inlet body bearing the motive flow inlet and the secondary flow inlet;

a diffuser body forming the diffuser and bearing the outlet;

a motive nozzle insert forming the motive nozzle in a compartment in the inlet body;

a control needle shiftable between a first position and a second position; and a needle guide insert in the motive nozzle insert, wherein a motive flow flowpath extends sequentially from the motive flow inlet, into the motive nozzle insert, through the needle guide insert, and out the motive nozzle, the method comprising:

inserting the needle guide insert into the motive nozzle insert;

inserting the motive nozzle insert into the compartment from an opening in a downstream end of the inlet body; and mating the diffuser body to the downstream end of the inlet body.

17. The method of claim 16 further comprising:

brazing the needle guide insert to the motive nozzle insert.

18. The method of claim 16 wherein:

the mating the diffuser body to the downstream end of the inlet body comprises threading.

19. The method of claim 16 further comprising:

brazing the motive nozzle insert to the inlet body.

20. The method of claim 16 further comprising:

mounting a needle actuator to a first end of the inlet body axially opposite the downstream end, and wherein:

after the inserting of the needle guide insert and the inserting of the motive nozzle insert, the needle guide insert is axially to the downstream end side of the motive flow inlet.

* * * * *